US006062326A

United States Patent [19]

Strong et al.

[11] Patent Number: 6,062,326

[45] Date of Patent: May 16, 2000

[54] CASING SHOE WITH CUTTING MEANS

[75] Inventors: Philip Strong, Aberdeen; Michael Wardley, Laurencekirk, both of United Kingdom

[73] Assignee: Enterprise Oil plc, Aberdeen, United Kingdom

[21] Appl. No.: 08/913,379

[22] PCT Filed: Mar. 11, 1996

[86] PCT No.: PCT/GB96/00556

§ 371 Date: Sep. 16, 1998

§ 102(e) Date: Sep. 16, 1998

[87] PCT Pub. No.: WO96/28635

PCT Pub. Date: Sep. 19, 1996

[30] Foreign Application Priority Data

Mar. 11, 1995 [GB] United Kingdom ..... 9504968

[51] Int. Cl.[7] ..... E21B 17/14

[52] U.S. Cl. ..... 175/402; 175/323; 166/242.8

[58] Field of Search ..... 166/242.8; 175/320, 175/323, 402

[56] References Cited

U.S. PATENT DOCUMENTS

| | | | |
|---|---|---|---|
| 2,334,788 | 11/1943 | O'Leary . | |
| 3,266,577 | 8/1966 | Turner . | |
| 4,413,682 | 11/1983 | Callihan et al. | 166/382 |
| 4,618,010 | 10/1986 | Falgout, Sr. et al. . | |
| 5,289,889 | 3/1994 | Gearhart et al. . | |
| 5,322,139 | 6/1994 | Rose et al. | 175/414 |
| 5,341,888 | 8/1994 | Deschutter | 175/323 |

FOREIGN PATENT DOCUMENTS

| | | |
|---|---|---|
| 1222448 | 6/1987 | Canada . |
| 0028121 | 5/1981 | European Pat. Off. . |
| 2170528 | 8/1986 | United Kingdom . |
| 93/25794 | 12/1993 | WIPO . |

OTHER PUBLICATIONS

Notice of Opposition to Counterpart European Patent No. 0815342 dated Sep. 9, 1999.
B & W Incorporated Catalogue Extract I (undated).
IADC/SPE, Paper 39399, dated 1998.
Diamant Boart Stratabit Composite Catalogue (undated on copy except for handwritten "90/91").
B&W Incorporated Catalogue Extract II (undated on copy).
Various Catalogue Extracts (undated on copies).
B P"Downhole Talk" (Nov. 1994).
Fax letter from George Givens to Alistair Clark of May 23, 1997 and enclosures.
Print–off of e–mail form George Givens to Alistair Clark of Aug. 30, 1999 and enclosures.
Photographs of modified Baker "V" Shoes (undated).
B P Internal Memorandum, reference FGS–94, dated Aug. 16, 1994.

*Primary Examiner*—David Bagnell
*Assistant Examiner*—Zakiya Walker
*Attorney, Agent, or Firm*—Ratner & Prestia

[57] ABSTRACT

A casing shoe (30) for use in guiding a casing into a wellbore comprises a generally cylindrical body (2) having a box portion (34) at its rearward end for connection to a casing string and having a generally rounded nose portion (36) at its forward end. The forward end of the shoe includes cutting structures (42, 44) in the form of raised flutes extending along the sides of the cylindrical body and on the nose portion. The flutes may be provided with cutting elements such as polycrystalline diamond compact elements (48) at least at the forward ends of the flutes (42) extending along the cylindrical body. These flutes may also be configured to serve as stabilising pads, and additional stabilising pads (38) may also be provided. The nose portion may include fluid passages (50). The shoe may be adapted to be capable of being drilled through, such as by forming the nose portion from a drillable material. The provision of cutting structures on the casing shoe allows the tool to remove or negotiate obstacles which would prevent the passage of conventional casing shoes. The trailing ends of the various flutes may be provided with abrasive material to provide a back-reaming capability. The nose portion may also be eccentrically shaped to assist in negotiating obstacles.

21 Claims, 5 Drawing Sheets

CASING SHOE WITH CUTTING MEANS

The present invention relates to casing shoes of the type used typically in wellbores or boreholes for guiding a casing into the wellbore. The invention relates more particularly to an improved casing shoe adapted both to guide the casing into the wellbore and to perform a degree of drilling and/or reaming of the earth formation. Preferably, the casing shoe will not obstruct the passage of subsequent tools into the well.

It is known, standard practice to use casing shoes for the purpose of guiding a casing string into a wellbore. An example of a typical casing shoe 10 is illustrated in FIG. 1. When running a casing string into a wellbore, the casing string requires a leading edge capable of guiding the string since there may be partial obstructions in the wellbore, such as ledges for example. A standard casing shoe is adequate for this purpose provided that the obstructions encountered are not too severe.

The shoe shown in FIG. 1 comprises a generally cylindrical steel casing 12 having an internally threaded box portion 14 for connection to a complementary pin portion of a casing string, and a central portion 16 of drillable material (such as cement, aluminium, plastics or the like) secured in the interior of the casing 12 forward of the box portion 14 and having a generally rounded nose projecting frontwards beyond the forward end of the casing 12. The central portion 16 has a through-bore 18 to allow the passage of fluids. A shoe of this type may incorporate other, associated equipment, such as a unidirectional ball-valve (not shown) in the bore 18, which inhibits flow of mud from the wellbore into the casing string whilst running the casing, but allows flow of cement from the bore of the casing string into the annulus between the casing string and the wellbore after the full length of the casing string has been run into the wellbore. The present invention may also incorporate such additional, associated equipment.

An important feature of most casing shoes is that the central portion 16 is drillable by standard oilfield drill bits, since it may subsequently be necessary to drill a further section of wellbore beyond the casing shoe. However, there is also a requirement for casing shoes which are not capable of being drilled through.

The advent in recent years of highly deviated or horizontal wells in the oil industry has increased both the frequency and seriousness of difficulties encountered while running wellbore casing strings, to the extent where a conventional casing shoe may be unable to pass a particular obstruction in the wellbore. Obstructions may arise from the bore of the well itself swelling inwardly, as is sometimes the case with hydratable shales for example, or when the wellbore contains ledges caused by drilling through rock formations of differing hardnesses, or due to the accumulation of loose material in the wellbore being ploughed up ahead of the casing shoe until further progress is no longer possible.

This last situation is illustrated in FIG. 2, which shows the casing shoe 10 of FIG. 1 attached to a casing string 20 being run in a near-horizontal wellbore 22 surrounded by competent formation 24. The passage of the casing shoe 10 along the wellbore 22 is obstructed by an unconsolidated formation 26 of loose material.

The consequence of encountering such difficulties are, at best, delays in the schedule of the well programme and, at worst, having to drill all or part of the well again. In any case, significant additional cost is involved.

It is an object of the present invention to provide an improved casing shoe which performs the string-guiding function of standard casing shoes, but which is capable of clearing obstructions which would halt the passage of conventional shoes. In the preferred embodiments of the invention, this involves the ability to ream swelled subsurface formations and/or to deal with large quantities of unconsolidated solids, whilst (preferably) allowing the subsequent passage of other equipment.

In accordance with the present invention there is provided a casing shoe comprising a generally cylindrical body having a first end adapted for connection to a casing string and having a second end including a generally rounded nose portion, said casing shoe further including cutting means adapted to ream, drill, cut or displace obstacles encountered in use of the casing shoe in a borehole.

Preferably, said cutting means includes cutting structures disposed along the sides of said generally cylindrical body and on said nose portion.

Preferably also, said cutting structures comprise a plurality of raised flutes extending along at least a portion of said cylindrical body and converging towards the forward end of said nose portion.

Preferably also, said flutes are provided with cutting elements such as polycrystalline diamond compact (PDC) elements.

Preferably also, said cutting elements are located at least on those portions of said flutes extending along said cylindrical body adjacent said nose portion.

Preferably, rearward portions of said flutes extending along the sides of said cylindrical body are configured as stabilising pads.

Preferably also, the outer faces of said rearward portions are provided with hard facing of tungsten carbide or the like, and the trailing ends of said rearward portions are provided with abrasive material, such as aggressive tungsten carbide, to enable a degree of back-reaming.

Preferably also, those portions of said flutes located on said nose portion include cutting elements such as tungsten carbide discs, shaped ceramics or angular aggregate.

In one preferred embodiment, said cutting structures include primary cutting structures including first raised flutes extending along at least a portion of said cylindrical body and terminating at said second end thereof.

Preferably also, the forward ends of said cylindrical body and of said first flutes taper inwardly to the inner diameter of said cylindrical body, and said forward ends of said first flutes include cutting elements such as polycrystalline diamond compact (PDC) elements.

Preferably, said cutting structures also include secondary cutting structures located on said rounded nose portion said secondary cutting structures comprising extensions of said first flutes extending from the ends of said first flutes towards the centre of said nose portion.

In certain embodiments, at least a portion of the interior bore of said cylindrical body adjacent said second end contains an inner portion of drillable material secured thereto, said rounded nose of the casing shoe being formed by said inner portion projecting beyond said second end of said cylindrical body.

Preferably, said flute extensions of said secondary cutting structures are formed integrally with said rounded nose from the material of said inner portion.

The following features are preferably included in all embodiments of the invention:

- said nose portion may have at least one through bore formed therein to communicate with the interior of said cylindrical body;
- the casing shoe may further include stabilising means, suitably comprising a plurality of spiral flutes, which may be formed integrally with the cylindrical body of the casing shoe, or may be provided on a separate cylindrical body adapted to be connected between the casing shoe and a casing string; the outer faces of said spiral flutes are preferably provided with hard facing of tungsten carbide or the like, and the trailing ends of said spiral flutes are provided with abrasive material, such as aggressive tungsten carbide, to enable a degree of back-reaming; the forward ends of said spiral flutes are preferably provided with abrasive material, such as aggressive tungsten carbide, to protect the flutes from damage during forward motion of the shoe.

Where the shoe is required to be capable of being drilled through, the rounded nose portion may be formed as a hollow structure capable of being drilled through, deformed or displaced if required to enable subsequent drilling operations.

In a further variation of the invention, the rounded nose portion may be eccentrically shaped to assist in negotiating obstructions.

Embodiments of the invention will now be described, by way of example only, with reference to the accompanying drawings in which.

Figure 1:
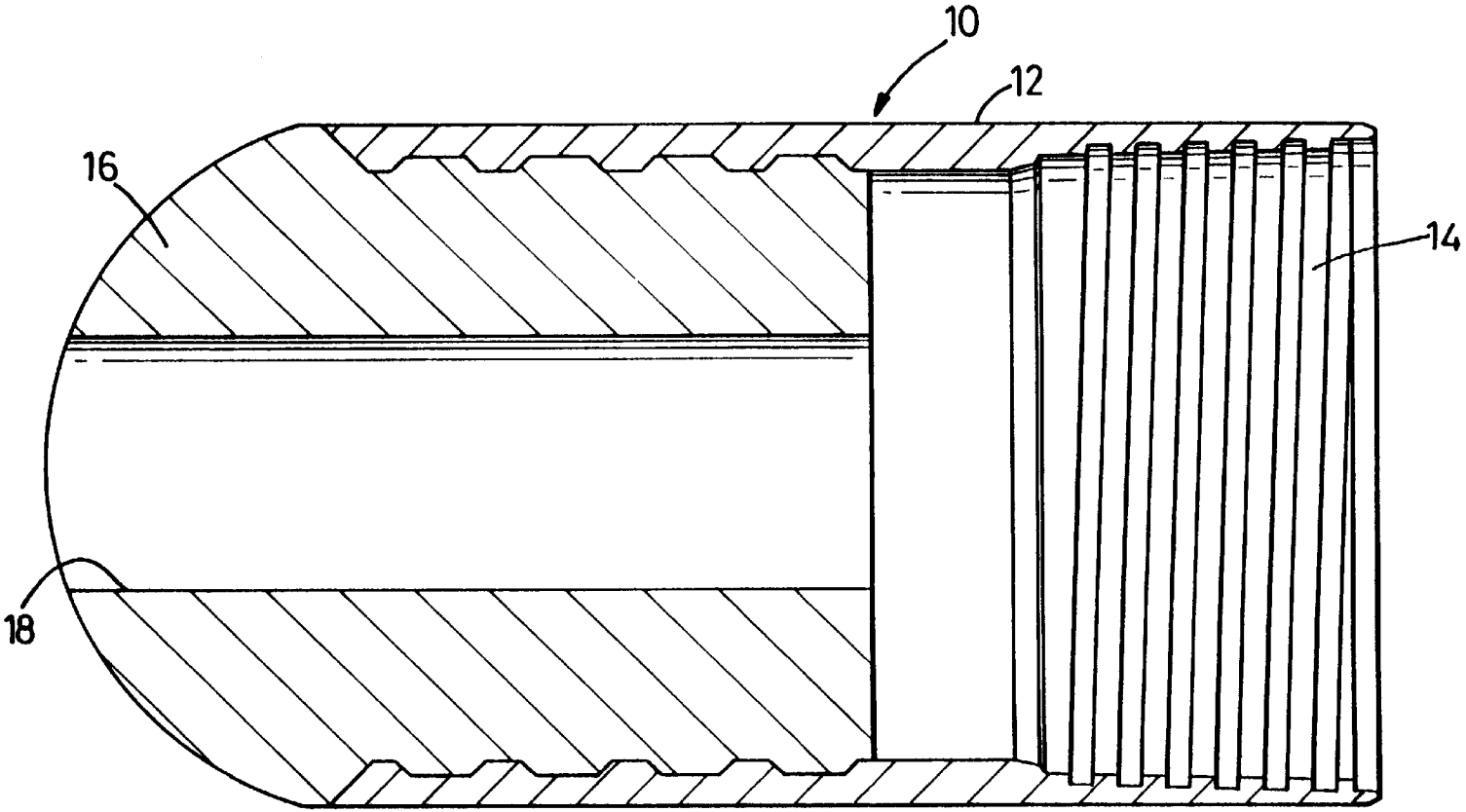
Fig. 1 (PRIOR ART)
FIG. 1 is a sectional side view of a conventional casing shoe.
Figure 2:
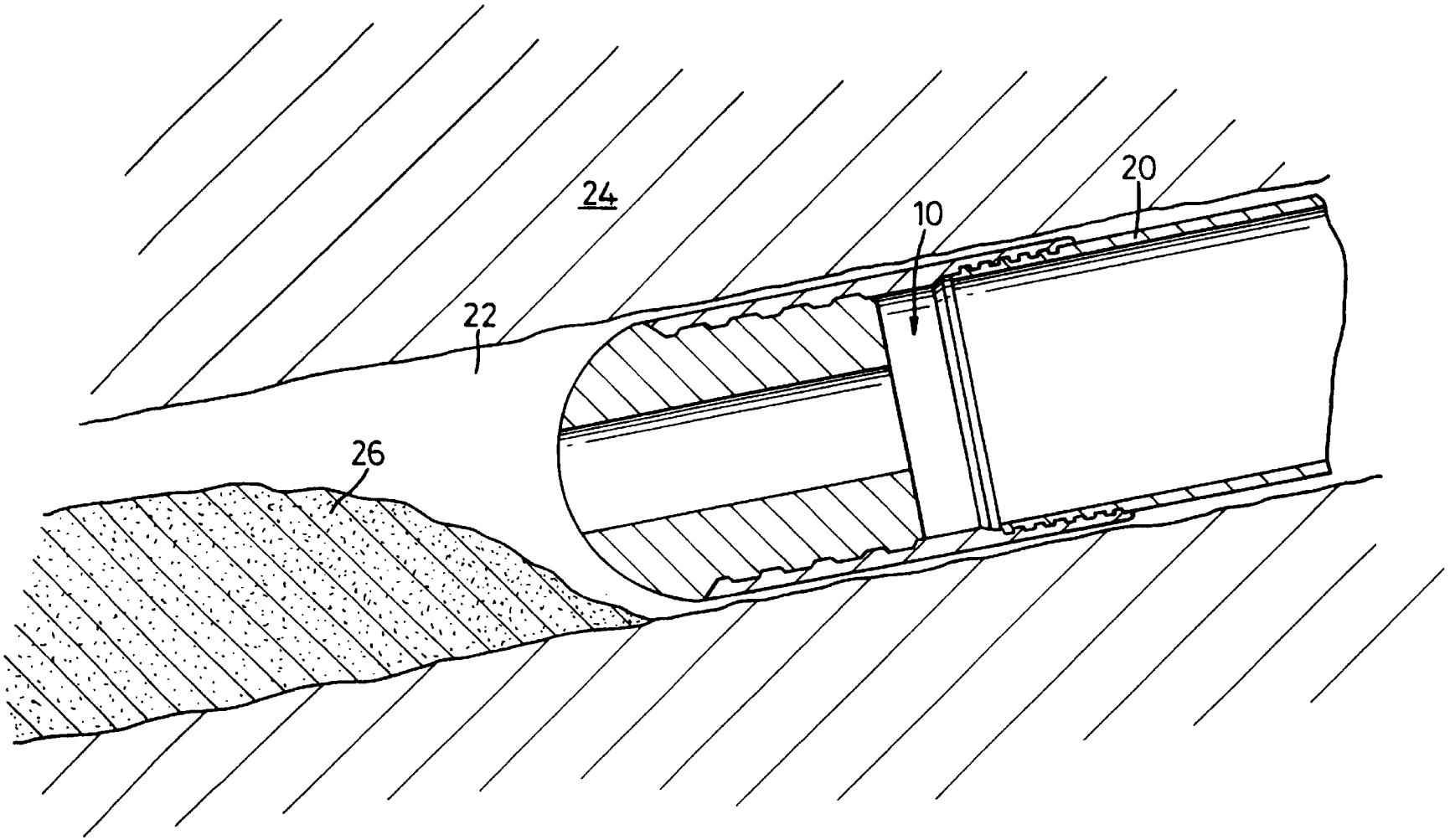
FIG. 2 is a sectional side view of the casing shoe of FIG. 1 approaching an obstruction in a wellbore.
Figure 3:
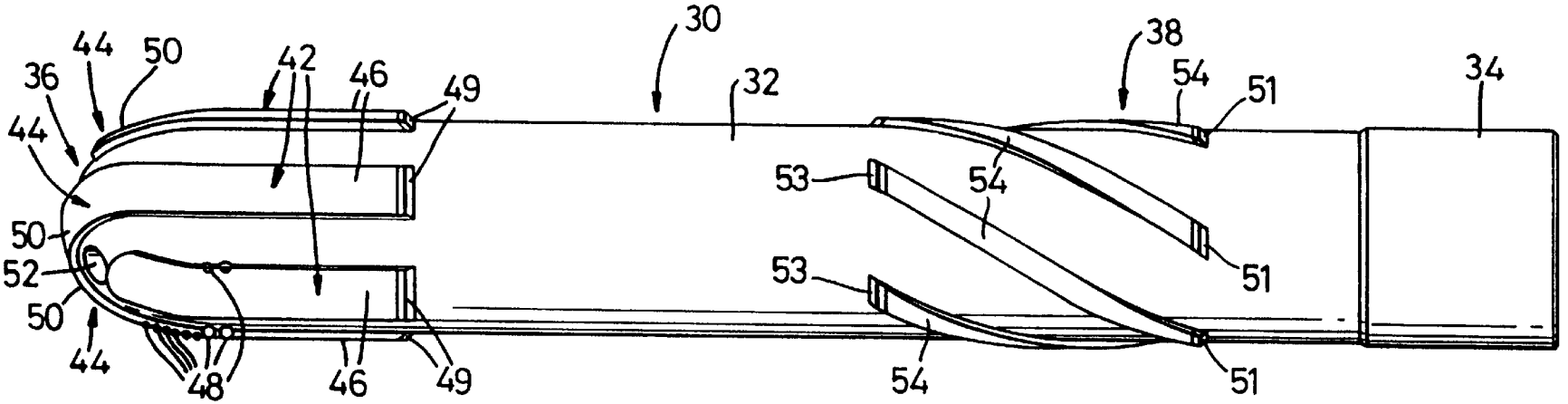
FIG. 3 is a side view of an example of a casing shoe embodying the present invention.
Figure 4:
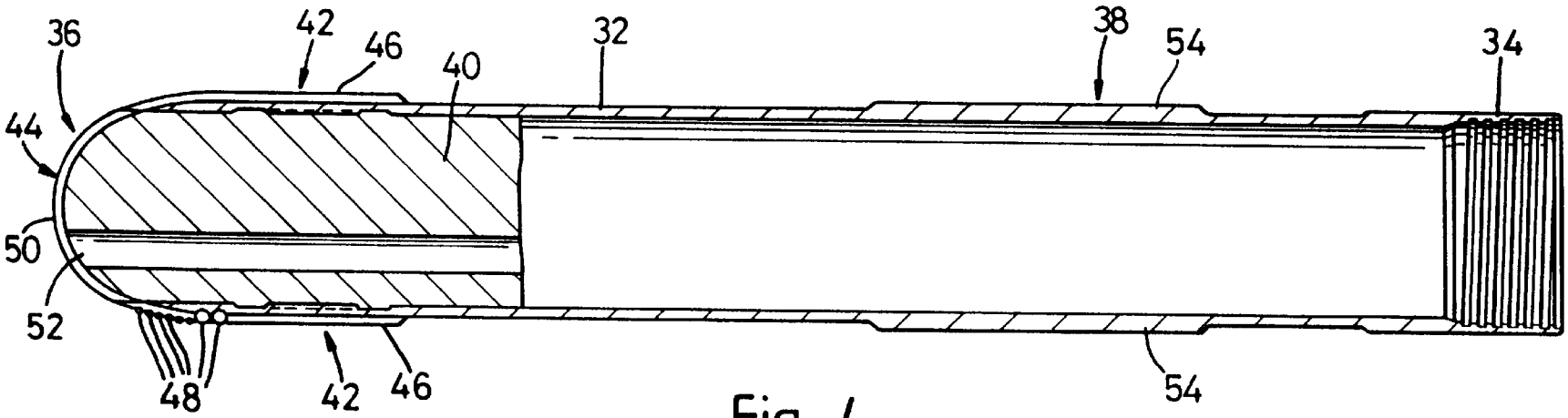
FIG. 4 is a sectional side view of the casing shoe of FIG. 3.

Referring now to the drawings, FIGS. 3 and 4 show an example of a casing shoe 30 in accordance with the invention.

The shoe 30 comprises a generally cylindrical steel casing 32 having an internally threaded box portion 34 at its tail end, for connection to a casing string (not shown), and having a generally rounded nose portion 36 at its front end, as shall be described in greater detail below. Optionally, the shoe 30 may also include a stabiliser portion 38, as shall also be discussed in greater detail below.

In this embodiment, the shoe 30 also includes a central portion 40 of drillable material, the forward end of which forms the rounded nose 36. This portion may be of cement, aluminium, plastics or the like. The type of material from which it is formed may depend upon the type of drill bit which will be required to drill it out, should this prove necessary.

In accordance with the invention, the forward end of the shoe 30 is provided with cutting structures which enable the tool to ream, drill, cut or displace obstacles such as inward swellings of the competent formation and/or accumulations of unconsolidated solids. In this example, the shoe 30 includes primary cutting structures extending along the sides of the forward end of the shoe and intended primarily for reaming inward swellings of the formation, and secondary cutting structures, generally designated by the numeral 44, incorporated in the rounded nose 36 and intended primarily for the displacement of unconsolidated solids.

The primary cutting structures comprise a plurality of linear flutes 42 extending substantially parallel to one another to the forward end of the casing 32 and spaced equidistantly around the circumference thereof, and having suitable cutting elements, such as polycrystalline diamond compact (PDC) elements, set into their lateral edges, as indicated at 48. As seen in FIG. 4, the walls of the casing 32 are tapered inwardly towards the forward end thereof and the forward ends of the flutes 42 follow the tapered contour of the casing walls and terminate at the inner diameter of the casing 32. The PDC's 48 are located along the tapered forward portions of the flutes 42. The rearward portions 46 of the flutes 42 extending along the sides of the casing 32 are configured as stabilising pads and may be provided with hard facings of material such as tungsten carbide. The trailing ends of the flutes 46 may also be provided with abrasive elements 49 of material such as aggressive tungsten carbide, providing a back-reaming capability.

The secondary cutting structures 44 comprise contiguous extensions 50 of the flutes 42, formed integrally with the drillable material of the central portion 40 and extending towards the centre of the rounded nose 36. The configuration of the secondary cutting structures 44 is more clearly seen in FIG. 5. In this example there are six primary flutes 42 and six corresponding extensions 50, of which alternate extensions are designated 50*a* in FIG. 5 and intervening extensions are designated 50*b*. The alternate flute extensions 50*a* converge at the centre of the nose 36, and the intervening flute extensions 50*b* terminate outwardly of the centre. Depending upon the type of obstructions expected to be encountered by the secondary cutting structures 44, cutting elements (not shown) such as tungsten carbide discs, shaped ceramics or angular aggregate might be incorporated therein, or cutting might be performed by the flute extensions 50 themselves. Where the casing shoe is adapted to be capable of being drilled through, as in this example, it may be preferable to omit hard cutting elements from the drillable portion of the nose, since such elements may interfere with the drilling through of the tool.

One or more through bores 52 may be formed in the central portion 40, to allow the passage of drilling fluids, cement etc from the interior of the casing string to the external annulus as may be required in use of the shoe. In particular, the bores 52 allow the passage of drilling fluid to flush away debris created by the cutting action of the tool. The spaces between the flutes 42, 50 of the primary and secondary cutting structures also serve as fluid passages for fluid between the tool face and the annulus between the casing string and the borehole. In this example, there are three bores 52, the forward ends of which are disposed between the ends of the intervening flute extensions 50*b* and the centre of the nose 36. If required, the bores 52 may be fitted with valves etc (not shown) as in prior art casing shoes.

The optional stabiliser portion 38 may be used to provide a particular directional response from the tool or to act as a pivot point to assist the tool in negotiating obstacles. In this example, the stabiliser comprises a plurality of spiral flutes 54, formed integrally with the casing 32. Alternatively, the stabiliser could be provided as a separate component (not shown), having its own threaded box and pin, which can be connected between the shoe 30 and the casing string. In this case the shoe itself could be substantially shorter in length than the illustrated example with its integral stabiliser 38.

The outer faces of said spiral flutes 38 may also be provided with hard facing of tungsten carbide or the like, as with the rearward portions 46 of the flutes 42, and their trailing ends may also provided with abrasive elements 51, such as aggressive tungsten carbide, to assist back-reaming. The forward ends of the spiral flutes 38 may similarly be provided with abrasive elements 53, to protect the flutes 38 from damage during forward motion of the shoe 30.

In a variation of this drillable embodiment of the invention, the inner portion 40 might be omitted and the rounded nose formed as a hollow structure designed to be capable of being drilled through or displaced forwardly and outwardly into a region defined approximately by forward extension of the casing 32. Such displacement would take place after the casing string has been run to its full depth and before it has been cemented in place. The displacement might suitably take place as an integral part of the cementing procedure. A hollow nose of this type might suitably take the form of a segmented dome structure which is plastically deformable in response to hydraulic pressure associated with the injection of cement. Alternatively, the dome segments might be hinged to the forward end of the tubular casing 32. In either case, the nose structure may include ribs or the like providing the secondary cutting structures.

Figure 6:
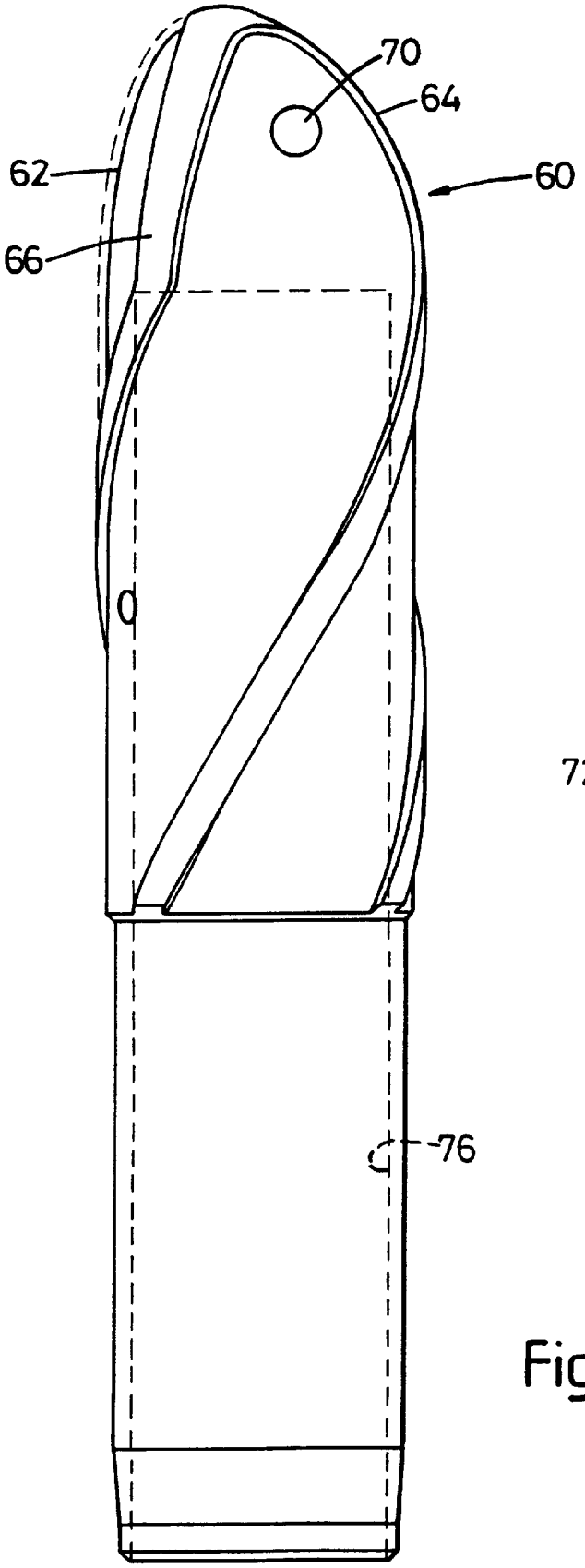
FIG. 6 is a side view of a further example of a casing shoe embodying the present invention.
Figure 7:
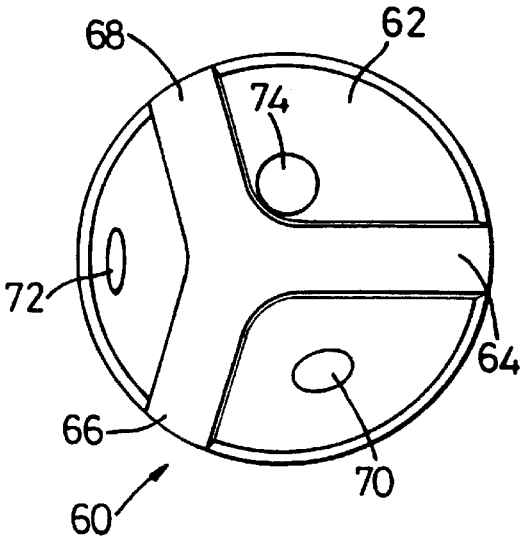
FIG. 7 is a front end view of the casing shoe of FIG. 6.

In a further variation, the nose portion of the tool may be eccentrically shaped so as to impart a cyclic lateral motion upon encountering an obstruction. This may assist in negotiating such obstructions. FIGS. 6 and 7 of the drawings show an example of a casing shoe 60 in accordance with the invention, having an eccentrically shaped nose portion 62 of this type. The cutting structures in this example comprise three spiral flutes 64, 66, 68, converging at the forward end of the nose portion 62. The flutes may be provided with cutting elements (not shown) such as PDC cutters, as required, and the shoe may include fluid passages, having outlets 70, 72, 74 in the nose portion 62, as in the previous embodiment.

The embodiment of FIGS. 6 and 7 is also an example of a "non-drillable" shoe; i.e. it does not include any portion purposely designed to be capable of being drilled through. The shoe has an internal blind bore 76, which terminates around the point where the generally cylindrical body of the shoe begins to taper to form the nose portion 62. Accordingly, the nose portion 62 is solid, except for the fluid channels (not shown) extending therethrough.

Figure 5:
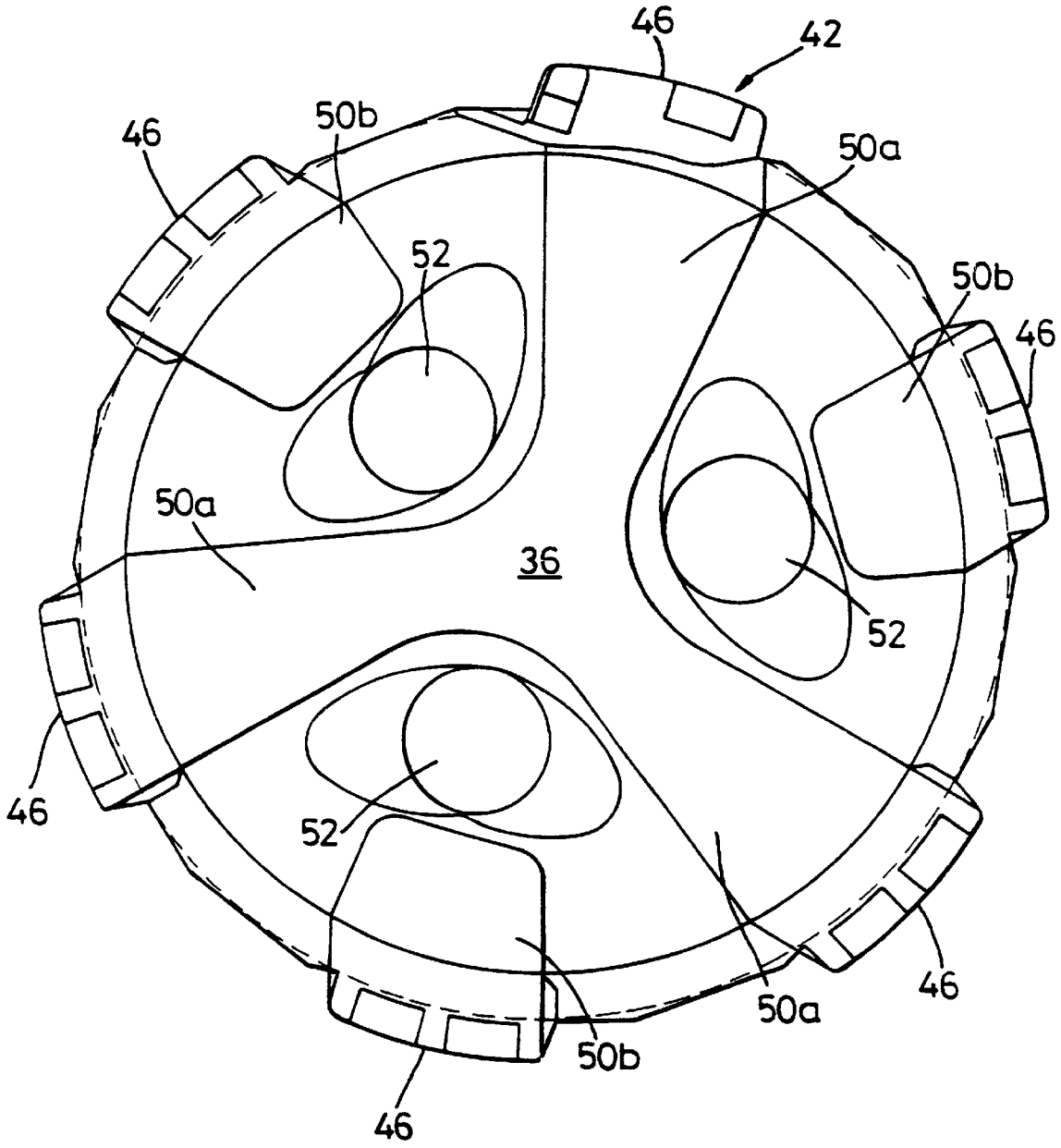
FIG. 5 is a front end view of the casing shoe of FIGS. 3 and 4.

It will be appreciated that this embodiment could be made to be drillable in a similar manner as the previous embodiment and that, conversely, the drillable embodiment of FIGS. 3–5 could be made non-drillable in the same way as that of FIGS. 6 and 7. Also, the embodiment of FIGS. 6 and 7 could be modified to incorporate an integral stabiliser portion, if required. In non-drillable embodiments of the invention, hard cutting elements may be located anywhere on the nose portion as required.

The provision of cutting structures on the casing shoe allows the tool to remove or negotiate obstacles which would prevent the passage of conventional casing shoes. Other features such as the stabiliser also assist in the negotiation of obstacles.

Improvements or modifications may be incorporated without departing from the scope of the invention.

We claim:

1. A casing shoe comprising a generally cylindrical body having a first end adapted for connection to a casing string and having a second end including a generally rounded nose portion having a forward end, said casing shoe further including cutting means adapted to ream, drill, cut or displace obstacles encountered in use of the casing shoe in a borehole, wherein said cutting means includes cutting structures disposed along the sides of said generally cylindrical body and on said nose portion, and wherein said cutting structures comprise a plurality of raised flutes extending along at least a portion of said cylindrical body and converging towards the forward end of said nose portion.

2. A casing shoe as claimed in claim 1, wherein said flutes are provided with cutting elements such as polycrystalline diamond compact (PDC) elements.

3. A casing shoe as claimed in claim 2, wherein said cutting elements are located at least on those portions of said flutes extending along said cylindrical body adjacent said nose portion.

4. A casing shoe as claimed in claim 1, wherein rearward portions of said flutes extending along the sides of said cylindrical body are configured as stabilising pads.

5. A casing shoe as claimed in claim 4, wherein said rearward portions include outer faces with trailing ends, and the outer faces are provided with a hard facing of tungsten carbide or the like, and the trailing ends of said rearward portions are provided with abrasive material, such as aggressive tungsten carbide, to enable a degree of back-reaming.

6. A casing shoe as claimed in claim 1, wherein those portions of said flutes located on said nose portion include cutting elements such as tungsten carbide discs, shaped ceramics or angular aggregate.

7. A casing shoe as claimed in claim 1, wherein said cutting structures include primary cutting structures including first raised flutes extending along at least a portion of said cylindrical body and terminating at said second end thereof.

8. A casing shoe as claimed in claim 7, said cylindrical body having an outer surface and an inner diameter and said first flutes having forward ends, wherein the outer surface of said cylindrical body adjacent the second end thereof and the forward ends of said first flutes taper inwardly to the inner diameter of said cylindrical body, and said forward ends of said first flutes include cutting elements such as polycrystalline diamond compact (PDC) elements.

9. A casing shoe as claimed in claim 7, wherein said cutting structures also include secondary cutting structures located on said rounded nose portion, said secondary cutting structures comprising extensions of said first flutes extending from said second end of said cylindrical body towards the forward end of said nose portion.

10. A casing shoe as claimed in claim 9, said cylindrical body having an interior bore and wherein at least a portion of the interior bore of said cylindrical body adjacent said second end contains an inner portion of drillable material secured thereto, said rounded nose of the casing shoe being formed by said inner portion projecting beyond said second end of said cylindrical body.

11. A casing shoe as claimed in claim 10, wherein said flute extensions of said secondary cutting structures are formed integrally with said rounded nose from the drillable material of said inner portion.

12. A casing shoe as claimed in claim 1, said cylindrical body having an interior bore and wherein at least a portion of the interior bore of said cylindrical body adjacent said second end contains an inner portion of drillable material secured thereto, said rounded nose of the casing shoe being formed by said inner portion projecting beyond said second end of said cylindrical body.

13. A casing shoe as claimed in claim 1, wherein said cylindrical body is hollow and said nose portion has at least one through bore formed therein to communicate with the interior of said hollow cylindrical body.

14. A casing shoe as claimed in claim 1, further including stabilising means.

15. A casing shoe as claimed in claim 14, wherein said stabilising means comprises a plurality of spiral flutes.

16. A casing shoe as claimed in claim 15, wherein said spiral flutes are formed integrally with the cylindrical body of the casing shoe.

17. A casing shoe as claimed in claim 15, wherein said spiral flutes are provided on a separate cylindrical body adapted to be connected between the casing shoe and a casing string.

18. A casing shoe as claimed in claim 15, said spiral flutes having outer faces and trailing ends, wherein the outer faces of said spiral flutes are provided with hard facing of tungsten carbide or the like, and the trailing ends of said spiral flutes are provided with abrasive material, such as aggressive tungsten carbide, to enable a degree of back-reaming.

19. A casing shoe as claimed in claim 15, said spiral flutes having forward ends, wherein the forward ends of said spiral flutes are provided with abrasive material, such as aggressive tungsten carbide, to protect the flutes from damage during forward motion of the shoe.

20. A casing shoe as claimed in claim 1, wherein said rounded nose portion is formed as a hollow structure capable of being drilled through, deformed or displaced if required to enable subsequent drilling operations.

21. A casing shoe as claimed in claim 1, wherein said rounded nose portion is eccentrically shaped to assist in negotiating obstructions.

* * * * *